United States Patent [19]

Risken

[11] 3,931,418

[45] Jan. 6, 1976

[54] PROCESS FOR THE PRODUCTION OF INSULATING COATINGS ON ELECTRICAL CONDUCTORS

[75] Inventor: Karl-Heinz Risken, Mainz-Finthen, Germany

[73] Assignee: Dr. Kurt Herberts & Co. Gesellschaft mit beschrankter Haftung Vorm. Otto Louis Herberts, Wuppertal-Barmen, Germany

[22] Filed: Feb. 6, 1974

[21] Appl. No.: 440,054

[52] U.S. Cl. ..... 427/120; 260/75 R; 260/475 P; 427/388; 427/434; 427/435; 428/379

[51] Int. Cl.[2] ..... B05D 5/12; B05D 3/02

[58] Field of Search ..... 117/232, 161 K; 260/75 R, 260/475 P; 427/120, 388, 434, 435; 428/379

[56] References Cited

UNITED STATES PATENTS

| | | | |
|---|---|---|---|
| 2,216,234 | 10/1940 | Emig | 117/232 |
| 2,512,722 | 6/1950 | Lanham | 260/75 R |
| 2,671,744 | 3/1954 | Biefeld et al. | 117/126 GB |
| 2,683,100 | 7/1954 | Edgar et al. | 117/232 X |
| 2,686,740 | 8/1954 | Goodwin | 117/232 |
| 2,936,296 | 5/1960 | Precopio et al. | 117/232 X |
| 3,058,948 | 10/1962 | Mosimann et al. | 117/232 X |
| 3,118,861 | 1/1964 | Wiener | 260/475 P |
| 3,668,275 | 6/1972 | Riemhofer et al. | 117/161 K |
| 3,707,403 | 12/1972 | Dobbelstein et al. | 117/218 |
| 3,746,570 | 7/1973 | McIntosh | 117/161 K |

*Primary Examiner*—Harry J. Gwinnell
*Attorney, Agent, or Firm*—Donald D. Jeffery

[57] ABSTRACT

The invention relates to a process for the insulative coating of electrical conductors with thermosetting resins. According to the invention, the resins used are thermosetting ester resins produced from polyhydric alcohols, carboxylic acids with two or more carboxyl groups attached to an aromatic ring and, as optional components, an aliphatic carboxylic acid and amino group-containing compounds. Low molecular weight resins are used containing from 0.85 to 1 mol of polyhydric alcohols per equivalent of co-condensed carboxylic acid. The resins used have a melt viscosity of at most 40,000 m Pa s at 120°C. Coating is preferably carried out using a solvent-free composition, and at a low temperature.

21 Claims, No Drawings

PROCESS FOR THE PRODUCTION OF INSULATING COATINGS ON ELECTRICAL CONDUCTORS

BACKGROUND OF THE INVENTION

This invention relates to a process for the production of insulating coatings on electrical conductors by coating the conductors with thermosetting ester resins of polyhydric alcohols, polyvalent aromatic carboxylic acids, optionally aliphatic carboxylic acids and optionally compounds containing amino groups, and heating the coated conductors at elevated temperatures above 200° C. The resins also contain catalysts and leveling agents.

It is known that polyester resins can be converted into a form in which they are suitable for lacquering electrical conductors by dissolution of the resins in organic solvents of the phenol, cresol and/or xylenol type. The electrical conductors are insulated by coating them with a solution of the aforementioned polyester resins, followed by heating at oven temperatures of around 350° C. or higher to cure the polyester resins. Conventional lacquer solutions generally contain additives and/or hardeners of the kind normally employed for lacquers. Particularly preferred lacquer solutions are based on polyester resins containing five-membered imide rings in co-condensed form, for example, those resins disclosed in the following publications and patents: DAS No. 1,033,291; British Patent Nos. 937,377; 1,082,181; 1,067,541; 1,067,542 and 1,127,214; Belgian Patent No. 663,429; French Patent No. 1,391,834; East German Patent No. 30,838; DOS Nos. 1,494,454; 1,494,413; 1,937,310; 1,937,311; 1,966,084; 2,101,990 and 2,137,884. The disclosures of each citation is hereby incorporated by reference.

Conventional lacquer solutions have a relatively high organic solvent content. The stoving residue of the lacquer solutions generally amounts to less than 50% by weight. The reason for this is, inter alia, that the polyester resins dissolved in the solvents have relatively high molecular weights and structural arrangements in the molecule giving rise to high melting points and viscosities in solutions. The high solvent contents referred to above have to be used in order to obtain solutions of suitable viscosity for lacquering purposes. These solvents are evaporated off when the thin lacquer film surrounding the wire is subsequently heated at elevated temperatures of around 220° C. or higher, and hence are lost as film formers.

Accordingly, there is a considerable need for a process for producing insulating coatings on electrical conductors in which the use of the aforementioned solvents, at least in the large quantities indicated, can be avoided. This would afford considerable advantages by contributing to protection of the environment, reducing atmospheric pollution and the dangers to health in the coating plants and lacquer factories, increasing lacquer spread or yield, decreasing storage and transportation volume and reducing the risk of ignition.

Attempts have been made to meet this need by a process for insulating electrical conductors with heat-stable resins curable through free hydroxyl groups, especially non-linear polyester resins which can even be modified by amide or imide groups, by using in the melt, at a working temperature (lacquer bath temperature) of at least 100° C., resins which have been condensed at this temperature to such an extent that they do not undergo any appreciable further condensation in the melt, and which have crosslink equivalent weights of from 400 to 1600 (see DOS No. 2,135,157). However, it is in fact not possible in this process to use solvent-free resins at practicable lacquer bath temperatures. According to the examples of the aforementioned German Offenlegungsschrift, it is necessary to use from 10 to 15% of foreign, physiologically unacceptable solvents, such as xylenols or cresols. Despite these solvent contents, the process has to be carried out at melt temperatures of 170° or 160° C., as shown by the examples. The reason for this is that it is necessary in this process to use melts of products with as high a molecular weight as possible which, accordingly, melt only at elevated temperatures. In this connection, it is specifically pointed out in DOS No. 2,135,157, page 6, paragraph 1, second sentence, that the use of low molecular weight products has adverse effects.

SUMMARY OF THE INVENTION

It is therefore an object of the present invention to provide a process for the production of insulating coatings on electrical conductors by coating the conductors with compositions which contain ester resins, which have as high a stoving residue as possible and, in spite of this, can be applied to the conductors to be insulated at low temperatures.

A further object of the invention is to provide a process in which there is no need to use foreign solvents and which, nevertheless, can be carried out at relatively low melt temperatures of not more than 120° C.

Surprisingly, it has now been found that this object can be achieved, without losing any of the other favorable properties of conventional coatings on electrical conductors, by using polyester resins, optionally imide-modified or amide-modified ester resins, with an extremely low degree of polycondensation.

Thus, there is provided in accordance with the present invention a process for the production of insulating coatings on electrical conductors which comprises coating the conductors with thermosetting ester resins, typically containing catalysts and optional leveling agents, based on polyhydric alcohols, polyvalent carboxylic acids having carboxyl groups attached to an aromatic ring, and optionally containing aliphatic polycarboxylic acids, compounds containing amino groups, and/or compounds containing one or more five-membered imide rings, and heating the coated conductors to an elevated temperature, distinguished by the fact that the conductors are coated at a temperature between room temperature and 120° C. and preferably between room temperature and 100° C. with extremely low molecular weight ester resins, which contain from 0.85 to 1 mol of polyhydric alcohols in co-condensed form per equivalent of carboxylic acid, and which have a melt viscosity of at most 40,000 m Pa s[1] at temperatures of up to 120° C. Up to 25% of the ester groups may optionally be replaced by acid amide groups. Resins of this particular type are obtained by replacing some of the alcohols with amino alcohols or polyvalent amines.

[1] m Pa s = milli Pascal second = 1 centipoise

DETAILED DESCRIPTION OF THE INVENTION

The process according to the invention is carried out with particular advantage by coating the conductors in the absence of any foreign solvents. In the context of the invention, foreign solvents are solvents of the kind which do not take part in the reaction by which the ester resins are produced. If, therefore, the starting products used for this reaction, for example alcohols such as glycol, are not completely esterified during production of the ester resins, and if these incompletely esterified fractions are not removed from the resin, the solvents involved are not considered as foreign solvents in the context of the invention. Foreign solvents are primarily the cresol-like solvents normally used in the prior art (solvents of the phenol, cresol and xylenol type). The advantages outlined earlier are obtained to a particularly marked extent if, in accordance with this preferred embodiment, coating is carried out in the complete absence of foreign solvents. However, it is, of course, also possible to add a small quantity of foreign solvents. It is possible in this way to considerably reduce the viscosity of the coating composition. In other respects, the disadvantages referred to above must be accepted in cases where foreign solvents are used. Accordingly, the coating composition preferably contains a stoving residue of at least 70% by weight. This will be explained in more detail hereinafter.

Extremely low molecular weight ester resins of the kind whose melt viscosity amounts to at most 40,000 m Pa s at temperatures of up to 120° C, i.e., between room temperature and 120° C, are used in accordance with the invention. The lower limit for the melt viscosity is about 1,000 m Pa s. In the context of the invention, the melt viscosity of the resin is the viscosity of the ester resins as they are obtained by polycondensation of the starting materials without any further additives whatever, i.e., the viscosity of the pure ester resins. It is of particular advantage to use extremely low molecular weight ester resins of the kind which have a melt viscosity of at most 30,000 m Pa s, preferably from 1,000 to 30,000 m Pa s, at temperatures of up to 120° C.

One of the important features of the invention is that ester resins of extremely low molecular weight are used for coating. Preferably the number average molecular weight is between 250 to 700, most preferably between 300 and 600. These ester resins contain from 0.85 to 1 mol of dihydric and/or polyhydric alcohols in co-condensed form per equivalent of carboxylic acid. The polyesters contain preferably 0.9 to 1 mol, more preferably 0.95 to 1 mol and, with particular preference, from 0.98 to 1 mol of polyhydric alcohols, including the amino alcohols or polyvalent amines used, if any, in co-condensed form per equivalent of carboxylic acid. Thus, according to the invention, it is desirable that each carboxyl group available for the esterification reaction should be esterified with one molecule of alcohol in the polyester. Up to 25% of the ester groups can be replaced by carboxylic acid amide groups.

Basically, the ester resins used in accordance with the invention can be prepared from any of those compounds, i.e. carboxylic acids, alcohols and optionally compounds containing amino groups, which are employed in the prior art for the production of simple or modified polyester resins which are subsequently used in solution in lacquer solvents for insulating electrical conductors. Likewise, certain carboxylic acids, alcohols and compounds containing amino groups known in the prior art as producing particularly advantageous properties in the insulating coatings also constitute preferred embodiments of the present invention. As known from the prior art, the carboxylic acid used in accordance with the invention are also exclusively or at least predominantly those whose carboxylic groups are attached to an aromatic ring. In addition to these aromatic carboxylic acids, it is also possible to use aliphatic poly-carboxylic acids to a limited extent, preferably in a quantity of no more than 25 mol % and more preferably in a quantity of no more than about 10 mol %. The various prior art patents and publications cited above describe the conventional reactants in detail, and this discription is therefore not repeated here.

In the context of the invention, polyvalent compounds suitable for polyester formation also include those polyvalent carboxylic acids, alcohols or amino-group-containing compounds which contain five-membered imide rings, for example, polyvalent carboxylic acids obtained by reacting trimellitic acid anhydride with diamines to form so-called diimide dicarboxylic acids. Accordingly, the polyvalent carboxylic acids which are esterified with the alcohols can represent fairly complicated molecules. In the context of the invention, an equivalent of carboxylic acid is understood to be based on only those carboxyl groups of the carboxylic acids which are still available for an esterification reaction with the alcohols or for amide formation with amines used for this purpose.

Accordingly, the ester resins are produced by esterifying the aforementioned polyvalent carboxylic acids with polyhydric alcohols. In this connection, it is also possible to prepare heterocyclic carboxylic acids, for example, diimide dicarboxylic acids, and to esterify these diimide dicarboxylic acids with the alcohols in a single stage in one and the same vessel. This results because the amino groups react preferentially with the carboxyl groups in ortho relationship, or with anhydride groups, for example, trimellitic acid or its anhydride, to form five-membered imide rings. Thus, it is only those carboxyl groups of the carboxylic acid, or its anhydride, not reacting with amino groups to form five-membered imide rings which are left over for esterification with the alcohols. The ester imide resins may contain up to 5 % by weight of nitrogen bonded in five-membered imide rings.

In order to esterify the carboxyl groups available for the esterification reaction as completely as possible, it can be of advantage to use an excess of alcohols in production of the ester resins. This provides for rapid, complete esterification. However, no more than 1 mol of alcohol can of course be present in co-condensed form in the ester resins per equivalent of carboxylic acid, because each carboxyl group can react at most with 1 mol of alcohol. The molar excess of alcohols used in production of the ester resins, which can amount of 0.5 mol and preferably to 0.25 mol of alcohol (including the amino alcohols or polyvalent amines used, if any), per equivalent carboxylic acid, is removed as far as possible by conventional methods on completion of the esterification reaction. It is also possible for a small proportion of unreacted alcohol to be left behind in the reaction mixture, being subsequently evaporated during production of the insulating coatings on the electrical conductor.

According to the invention, for production of the polyester resins used in the melt, it is preferred to use carboxylic acids, alcohols and/or compounds containing amino groups of the kind which are at least partly trifunctional or greater, i.e., more than bifunctional, in order to obtain crosslinked products during stoving on the wire. There should be at least about 5 and preferably at least about 50 equivalents of compounds having a functionality of 3 or more, i.e., carboxylic acids, alcohols and/or compounds containing amino groups, to 100 equivalents of dicarboxylic acids in the polyesters. With regard to the upper limit, the polyesters should contain at most about 300, preferably at most about 200 and, with particular preference, at most about 100 equivalents of these higher functional compounds to 100 equivalents of dicarboxylic acids. In this context, higher functional compounds are compounds with more than two functional groups. Under this definition, the carboxyl groups are understood to be only those which are available for esterification or amide formation. In addition, the aforementioned higher functional carboxylic acids, alcohols and/or compounds containing amino groups preferably contain 3 or 4 and, with particular preference, 3 carboxyl, hydroxyl and/or amino groups in the molecule.

The ester resins used in accordance with the invention can also be prepared from reactive derivatives of the aforementioned compounds which are capable of forming ester bonds or amide bonds with the reaction components. Reactive derivatives of this kind are, in particular, the esters of the carboxylic acids with readily volatile aliphatic monoalcohols, especially those having from 1 to 4 carbon atoms. Standard commercial products of this kind are the methyl esters which, for this reason, are preferably used.

The reaction between the carboxylic acid, alcohol and optionally compounds containing amino groups, by which the polyesters used in the melt in accordance with the invention are formed, is completed when the acid number of the reaction mixture is very low. Since it is possible, in accordance with what has been said in the foregoing, to produce compounds with an extremely low degree of polycondensation, all the carboxyl groups can be esterified relatively easily, the esterification reaction being completed when the acid number is extremely low, preferably below 20 and, most preferably, below 10.

Standard esterification catalysts can be used for producing the ester resins from carboxylic acids and alcohols and optionally compounds containing amino groups. Examples of such catalysts include zinc acetate, antimony trioxide, metal amine complex catalysts, such as the complex compounds described in DAS No. 1,519,372, litharge, tin (II) oxalate, titanates, manganese (II) acetate, cerium (III) acetate and others.

Examples of the carboxylic acids which can be used for esterification include terephthalic acid, isophthalic acid, orthophthalic acid, trimellitic acid, pyromellitic acid, their esters or anhydrides, also products of the kind which can be obtained by reacting trimellitic acid with compounds containing at least two amino groups (cf. DOS No. 1,937,310; No. 1,937,311; No. 1,966,084; No. 2,101,990 and No. 2,137,884), as well as tris(2-carboxyethyl)-isocyanurate (TCEIC).

As already known from the prior art, the use of these particular carboxylic acids or those with five-membered imide rings leads to insulating coatings with a particularly high temperature resistance and other favorable properties.

Glycol, butylene glycols, propylene glycols, glycerin and tris-hydroxyethyl isocyanurate (THEIC), trimethylolpropane, trimethylolethane, are preferably used as the alcohols, as in the prior art.

The amines which can be reacted with the carboxyl groups available for the esterification reaction to form acid amide compounds, are aliphatic or aromatic compounds, as in the prior art. Examples include ethanolamine, ethylenediamine, aminomethylolpropane, p-aminobenzyl alcohol and the like.

Accordingly, the essential requirement of the invention is initially to form very small molecules which are not really polymers, but contain at the center a polyvalent carboxylic acid which is free from inter-molecular ester groups and acyclic amide bonds. For example, the ester may contain terephthalic acid or a diimide dicarboxylic acid having its carboxyl groups each esterified by one molecule of single-bond alcohol. The other hydroxyl groups of the alcohols (diols and higher functional alcohols) are preferably not esterified any further. This applies at least regarding the statistical distribution. In some cases, of course, the free hydroxyl groups can also be esterified once more with the dicarboxylic acid, especially in cases where less than 1 mol of alcohol is used per equivalent of carboxylic acid.

Crosslinking on the wire is then carried out by stoving at a temperature between about 200° C. and about 500° C. which initiates further polycondensation, accompanied by elimination of the diols and higher functional alcohols, if any. It is extremely surprising in this respect that a relatively large quantity of alcohols is eliminated on the wire, in spite of which a uniform coating free from any blisters is obtained. This contrasts with the view of experts in this technical field who in the past have attempted to use, for insulating the electrical conductors, products of the highest possible molecular weight from which only small quantities of volatile products are subsequently removed during stoving on the wire (cf. in particular DOS No. 2,135,157, page 4, paragraph 2, last sentence).

Since the polyesters used in accordance with the invention are of extremely low molecular weight and contain suitable structures for obtaining low melt viscosities, they have an extremely low melting range, and it is possible to carry out coating with melts of very low temperature. These temperatures are from about room temperature up to about 120° C., frequently to about 100° C. and even up to only about 60° C. It is possible to reduce the necessary lacquering temperature of the melt in accordance with the invention by adding small quantities of solvents to the melt. An addition of only a few percent of solvents, for example, up to 5% by weight or up to 10% by weight, produces such drastic reductions in viscosity and in the melting range that, in some cases, the melts actually exist as such at room temperature so that there is no need to heat the lacquering baths containing the ester resins. Even when the necessary lacquering temperatures of the melt amount to around 60° C., there is no need to heat the melt providing, as is standard practice in certain types of lacquering oven, the copper wires running repeatedly through the oven, on leaving the oven, are drawn through the melt again without cooling i.e., while still warm. However, the essential effect of the invention in this respect is that the ester resins used have such low melt temperatures and melt viscosities that, basically, there is no need to add any solvents or diluents.

Melts with a particularly low melting range are obtained by using mixtures of different ester resins. Such mixtures of different ester resins can be obtained in one reaction vessel by subjecting asymmetrical starting compounds or mixtures of sterically different starting products to the esterification reaction. This is of particular advantage in cases where starting products having a sterically simple molecular structure are used because it is possible in this way to obtain symmetrical polyester structures which produce a marked tendency towards crystallization. It is possible in this way to obtain solvent-free melts of the polyesters which are still liquid at low temperatures. Normally, no more than 10% of a foreign solvent is added, preferably not more than 5%.

One advantage of the process according to the invention over the prior art is that substantially solvent-free melts can be used at low application temperatures. The process according to the invention is preferably carried out with melts having a stoving residue of at least 70% by weight and, with particular preference, of at least 80% by weight. According to the invention, it is particularly preferred to use melts substantially free from solvents, especially foreign solvents, i.e., lacquer melts with a stoving residue of at least 85% by weight.

In the context of the invention, the stoving residue is the percentage content in the lacquer melt of substances which, in a test portion of 1.5 g., are left behind in an open metal weighing pan with a flat base and a diameter of 5 cm after heating for 1 hour in an oven heated to 180° C. Satisfactory distribution is obtained by adding 2 ml of a cresol-xylene solvent mixture (1 : 1) to the test portion of melt lacquer.

As already stated, it is not advisable and may even be difficult in some cases to remove the final traces of unreacted starting products, i.e., glycols and the like, completely from the resin. This is not necessary because these final traces are evaporated during stoving of the wire.

The process according to the invention is of particular advantage in cases where the solvent content is as small as possible and the stoving residue is as large as possible. This avoids evaporation of the solvents on the wire and the accompanying economic loss, also the other disadvantages in terms of environmental pollution, etc. Melt lacquers according to the invention can be adjusted by the addition of very small quantities of foreign solvents to produce viscosities which enable the melt to be processed at temperatures around room temperature.

As in cases where solvent-containing lacquers are used in accordance with the prior art, crosslinking on the wire is carried out at temperatures of at least 200° C., i.e., at oven temperatures above 300° C. and generally above 400° C. The upper temperature limit is essentially determined by the fact that the uniform coating on the wire should of course be prevented from decomposing.

So-called stoving catalysts can be added to the polyesters for stoving, as is standard practice in the prior art. Examples of stoving catalysts include monomeric or polymeric aryl or alkyl titanates, ortho-titanic acid ester compounds which form chelate complexes and other standard trans-esterification catalysts. These catalysts can be used by the artisan in any suitable selection and concentration. Normally, these catalysts are employed in an amount of from 0.001 to 8.0 % by weight of the stoving lacquer. It is only possible to use stoving catalysts of the kind which are homogeneously miscible with the coating composition used.

Additives such as silicone-containing leveling agents are often useful and it is within the scope of the prior art to add them to improve the lacquering behavior of the coating composition. Leveling agents are typically used in an amount between about 0.001 and 5.0% by weight.

In cases where solvent-containing lacquer solutions are used, as in the prior art, several thin layers are successively applied to the wire and individually stoved in order to ultimately obtain a multilayer coating with the most favorable insulating and mechanical properties. The layer thickness obtained after each individual stoving operation amounts to between 5 and 15 $\mu$ and to at most about 20 $\mu$ for a wire diameter of 1 mm, depending upon the nozzle diameter.

The products used in the lacquer melt in accordance with the invention also have the advantage of being extremely stable at the relatively low lacquering temperatures required.

The following examples are provided to facilitate an understanding of the present invention, it being understood that they are intended to be merely illustrative and not limitative.

EXAMPLE 1

1940 g (10.0 mols) of dimethylterephthalate,
368 g (4.0 mols) of glycerin
1140 g (15.0 mols) of 1,2-propane diol are introduced into a three-necked flask equipped with a stirrer, thermometer and rectification column. Following the addition of 3 g of zinc acetate, the contents of the flask are heated under a nitrogen atmosphere. The methanol liberated by trans-esterification begins to distil at around 140° to 150° C. Precautions must be taken to ensure that there are no losses of glycerin and 1,2-propane diol. Any losses of the polyhydric alcohols may have to be corrected during the reaction. After about 5 hours, 630 g of methanol have been distilled off, the temperature amounting to 210° C. The resin thus obtained has a final acid number of 2. It is liquid at 25° C. and has a viscosity of 1,000 m Pa s at 80° C.

Formulation of the coating composition 2.5% of monomeric butyl titanate (as hardener) and about 0.002% of silicone oil (Bayer's Baysiloloel OL) as leveler are added to the condensation product thus obtained with gentle heating and stirring to ensure that the additives are uniformly distributed. This is carried out at very low temperature. The coating composition, which has a stoving residue of 85%, is applied to copper wire at room temperature, i.e., without heating the lacquering bath. The lacquer melt bath is heated to around 45° C. by the copper wires passing through it.

EXAMPLE 2

1164 g (6.0 mols) of dimethylterephthalate,
285 g (3.1 mols) of glycerin
829 g (10.9 mols) of 1,2-propane diol are reacted together with 2.5 g of zinc acetate at a temperature of up to 200° C. in a three-necked flask equipped with a stirrer, thermometer and rectification column. 380 g of methanol are distilled off.

After cooling to around 150° C., 192 g (1.0 mol) of trimellitic acid anhydride and 99 g (0.5 mol) of 4,4'-diaminodiphenylmethane are added. 35 g of water are distilled off by further heating to 210° C. Another 192 g (1.0 mol) of trimellitic acid anhydride and 99 g (0.5 mol) of 4,4'-diaminodephenylmethane are added to the melt after cooling to 150° C. After about 35 g of water have been distilled off, the resin has an acid number of about 2.5. It is liquid at 25° C. with a viscosity of 2,000 m Pa s at 120 ° C.

Formulation of the coating composition

The condensation product thus obtained is heated until it is so thinly liquid that hardening catalysts and leveling agents can be mixed with it, as described in Example 1. In this connection, the material temperature is not increased to a higher temperature then absolutely necessary and under no circumstances to a temperature above 120° C. The coating composition is applied to copper wire and aluminum wire at 65° to 80° C. The melt lacquer has a stoving residue of 87% by weight.

EXAMPLE 3

776 g (4.0 mols) of dimethylterephthalate,
496 g (1.9 mols) of tris-(β-hydroxyethyl)-isocyanurate (THEIC)
502 g (8.1 mols) of ethylene glycol are reacted in the same way as described in Example 2. About 250 g of methanol are distilled off. After cooling to 150° C., 192 g (1.0 mol) of trimellitic acid anhydride and 99 g (0.5 mol) of 4,4'-diaminodiphenylmethane are added, and heating continued until 35 g of distillate have distilled over.

After cooling to 150° C., another 192 g (1.0 mol) of trimellitic acid anhydride and 99 g (0.5 mol) of 4,4'-diaminodiphenylmethane are added, and heating continued until about 35 g of water have distilled off. The resin has a final acid number of about 2.5. It is solid at 25° C. and has a viscosity of 3,800 m Pa s at 120° C.

Formulation of the coating composition

The condensation product thus obtained is brought by heating to a suitable viscosity, followed by the addition of hardening catalysts and leveling agents, as described in Example 1. The coating composition is applied to copper wire at 85° to 100° C. The melt lacquer contains a stoving residue of more than 90 % by weight

EXAMPLE 4

582 g (3.0 mols) of dimethylterephthalate,
705 g (2.7 mols) of tris-(β-hydroxyethyl)-isocyanurate (THEIC)
609 g (9.8 mols) of ethylene glycol are reacted in the same way as described in Example 2. About 190 g of methanol are distilled off.

After cooling to 150° C., 384 g (2.0 mols) of trimellitic acid anhydride and 198 g (1.0 mol) of 4,4'-diaminodiphenylmethane are added, and heating continued until 70 g of distillate have distilled off. After cooling to 150° C., another 384 g (2.0 mols) of trimellitic acid anhydride and 198 g (1.0 mol) of 4,4'-diaminodiphenylmethane are added, and heating continued until about 70 g of water have distilled off. The resin has a final acid number of about 3. It is solid at 25° C. and has a viscosity 6,000 m Pa s at 120° C.

Formulation of the coating composition

The condensation product thus obtained is gently heated, followed by the addition of hardening catalyst and leveling agent as described in Example 1. The coating composition is applied to copper wire at 85° to 105° C. The melt lacquer has a stoving residue of more than 90% by weight. In order to guarantee an adequate melt-lacquer temperature in the nozzles and to compensate the heat loss, the nozzles are heated. The viscosities of the melt resins are measured with a Haake Rotary Viscosimeter (type RV 1) and the high-temperature plate-and-cone assembly (type PK 401 W).

EXAMPLE 5

679 g (3.5 mols) of dimethylterephthalate,
496 g (1.9 mols) of tris-(β-hydroxyethyl)-isocyanurate (THEIC)
502 g (8.1 mols) of ethylene glycol are reacted in the same way as described in Example 2. About 250 g of methanol are distilled off. After cooling to 150° C., 73 g (0.5 mols) adipinic acid, 192 g (1.0 mol) of trimellitic acid anhydride and 99 g (0.5 mol) of 4,4'-diaminodiphenylmethane are added, and heating continued until 54 g of distillate have distilled over.

After cooling to 150° C., another 192 g (1.0 mol) of trimellitic acid anhydride and 99 g (0.5 mol) of 4,4'-diaminodiphenylmethane are added, and heating continued until about 35 g of water have distilled off. The resin has a final acid number of about 2.5. It is solid at 25° C. and has a viscosity of 2,700 m Pa s at 120° C.

Formulation of the coating composition

The condensation product thus obtained is brought by heating to a suitable viscosity, followed by the addition of hardening catalysts and leveling agents, as described in Example 1. The coating composition is applied to copper wire at 85° to 100° C. The melt lacquer contains a stoving residue of more than 90% by weight.

The coating compositions are applied in five or six layers to a 1.0 mm diameter copper wire by means of nozzles in a horizontal wire-lacquering oven about 3 metres long at a temperature of 400° to 450° C, and hardened. The lacquering rate amounts to between 6 and 10 metres per minute in Examples 1 and 2, and to between 6 and 12 metres per minute in Examples 3 and 4.

The test methods quoted in the following Table were carried out as follows:

1. Winding strength under pre-elongation: A piece of wire is pre-elongated to the percentage quoted and wound around a mandrel whose diameter is the same as the diameter of the tested wire. The insulated conductor is then examined for cracks in the lacquer coating. If no cracks are found, the tested wire is in order (i.O.). The degree of pre-elongation at which the wire is still in order is quoted. The test conditions are described in detail in DIN 46453, Section 5.1.2 — Sheet 1.

2. Heat shock test: 30 Minutes at 160° C: The wire is wound into a coil on a mandrel with the same diameter as the wire, stored in an oven for 30 minutes at 160° C and then examined as in 1 above. The test conditions are described in detail in DIN 46453, Sheet 1, Section 5.2.1.

The test is carried out in the same way at 180° C and 200° C, the only difference being that the oven is of course kept at 180° C and 200° C.

3. Softening point in ° C according to DIN 46453, Sheet 1, Section 5.22: The softening point is that temperature at which two wires which are arranged to cross one another at right-angles and which are loaded by standard weights, are short-circuited following the application of voltage and an increasing temperature.

Table 1

| Testing of the insulated wires produced the following results: | | | | | |
|---|---|---|---|---|---|
| Resin according to Example Number | 1 | 2 | 3 | 4 | 5 |
| Lacquer coating in μm according to DIN 46453 | 60 | 60 | 65 | 65 | 60 |
| Winding strength after pre-elongation | 15% | 20% | 15–20% | 20% | 15% |
| Heat-shock test | | | | | |
| 30 minutes at 160°C | i.O. | i.O. | i.O. | i.O. | i.O. |
| 30 minutes at 180°C | — | — | — | i.O. | — |
| 30 minutes at 200°C | — | — | — | i.O. | — |
| Softening point according to DIN 46453, Sheet 1, Section 5.22 | 260°C | 300°C | 330°C | 350°C | 350°C |

i.O. = in order

What is claimed is:

1. In a process for the production of an insulating coating on an electrical conductor comprising coating the conductor by passing the conductor through a bath of a thermosetting polyester-based stoving resin comprising a condensation product of a polyvalent aromatic carboxylic acid with a polyhydric alcohol and a stoving catalyst and thereafter heating the coated conductor to an elevated temperature sufficient to cure the condensation product, the improvement which comprises said polyester-based resin being a low molecular weight resin having from about 0.85 to 1 mole of polyhydric alcohol in co-condensed form per equivalent of polycarboxylic acid and having a melt viscosity of from 1,000 to 40,000 m Pa s at a temperature between room temperature and 120° C., said polyester-based resin containing a co-condensed carboxylic acid compound containing a five-membered imide ring and said coating being carried out by passing the conductor through a melt of said resin at a melt temperature between room temperature and 120° C., said melt being substantially free of solvents which do not take part in the reaction by which the polyester resins are produced and containing less than about 10% content of said solvent.

2. A process as defined by claim 1, wherein coating is carried out in the absence of said solvents.

3. A process as defined by claim 1, wherein the coating composition contains a stoving residue of at least 70% by weight.

4. A process as defined by claim 1, wherein the polyester resins have a resin melt viscosity of between 1,000 and 30,000 m Pa s at a temperature between room temperature and 120° C.

5. A process as defined by claim 1, wherein the polyester resins are low molecular weight resins having a number average molecular weight of from 250 to 700.

6. A process as defined by claim 5, wherein the polyesters contain from 0.95 to 1 mol of polyhydric alcohols in co-condensed form per equivalent of carboxylic acid.

7. A process as defined by claim 1, wherein the polyester additionally contains co-condensed carboxylic acids or alcohols having a functionality greater than 2.

8. A process as defined by claim 7, wherein there are from about 5 to about 300 equivalents of said carboxylic acids or alcohols having a functionality greater than 2 per 100 equivalents of dicarboxylic acid in the polyesters.

9. A process as defined by claim 8, wherein there are from about 50 to about 100 equivalents of said carboxylic acids or alcohols having a functionality greater than 2 per 100 equivalents of dicarboxylic acid in the polyesters.

10. A process as defined by claim 7, wherein the carboxylic acids or alcohols having a functionality greater than 2 contain 3 or 4 functional groups.

11. The process as defined by claim 1, wherein said polyester-based stoving resin additionally contains up to about 25 mole % of a co-condensed aliphatic polycarboxylic acid.

12. The process as defined by claim 1, wherein said polyester-based stoving resin additionally contains up to about 25 mole % of a co-condensed amino group-containing compound.

13. The process as defined by claim 3, wherein the coating composition contains a stoving residue of at least 80% by weight.

14. The process as defined by claim 13, wherein the coating composition contains a stoving residue of at least 85% by weight.

15. The process as defined by claim 1, wherein said melt temperature is between room temperature and about 100° C.

16. The process as defined by claim 15, wherein said melt temperature is between room temperature and about 60° C.

17. The process as defined by claim 16, wherein said melt temperature is room temperature.

18. The process as defined by claim 1, wherein said carboxylic acid compound containing a five-membered imide ring is derived from trimellitic acid or trimellitic anhydride and a diamine.

19. The process as defined by claim 1, wherein said polyhydric alcohol is selected from the group consisting of glycerin, butylene glycol, propylene glycol, ethylene glycol, tris-(β-hydroxyethyl)-isocyanurate, trimethylolpropane and trimethylolethane.

20. The process as defined by claim 1, wherein said polycarboxylic acid is selected from the group consisting of terephthalic acid, isophthalic acid, orthophthalic acid, trimellitic acid, pyromellitic acid, esters thereof, anhydrides thereof and tris-(2 carboxyethyl)-isocyanurate.

21. The process as defined by claim 12, wherein said amino group-containing compound is selected from the group consisting of ethanolamine, ethylene diamine, amino-methylolpropane and p-aminobenzyl alcohol.

* * * * *